US005881869A

United States Patent [19]

Hudson

[11] Patent Number: 5,881,869

[45] Date of Patent: Mar. 16, 1999

[54] MULTI-COMPONENT PACKAGING SYSTEM

[75] Inventor: Simon John Hudson, North Humberside, United Kingdom

[73] Assignee: Smith & Nephew Plc, United Kingdom

[21] Appl. No.: 656,306

[22] PCT Filed: Dec. 14, 1994

[86] PCT No.: PCT/GB94/02735

§ 371 Date: Aug. 21, 1996

§ 102(e) Date: Aug. 21, 1996

[87] PCT Pub. No.: WO95/16621

PCT Pub. Date: Jun. 22, 1995

[30] Foreign Application Priority Data

Dec. 18, 1993 [GB] United Kingdom ..... 9325944

[51] Int. Cl.[6] ..... B65D 25/08

[52] U.S. Cl. ..... 206/219; 222/94; 383/206; 604/290

[58] Field of Search ..... 206/568, 219; 222/92, 93, 94, 107, 145.1, 541.9, 541.1; 383/38, 206, 208, 209, 36, 207, 200, 202, 204, 205; 229/87.05; 604/290, 410

[56] References Cited

U.S. PATENT DOCUMENTS

| | | | |
|---|---|---|---|
| 2,350,931 | 6/1944 | Salfisberg | 383/209 |
| 3,199,671 | 8/1965 | Davy | 383/209 |
| 3,224,640 | 12/1965 | Schneider et al. | 383/38 |
| 4,266,692 | 5/1981 | Clark | 383/206 |
| 5,388,699 | 2/1995 | Ratajczak et al. | 383/38 |
| 5,461,845 | 10/1995 | Yeager | 383/206 |
| 5,465,767 | 11/1995 | Harms et al. | 222/541.9 |

*Primary Examiner*—Paul T. Sewell
*Assistant Examiner*—Nhan T. Lam
*Attorney, Agent, or Firm*—Larson & Taylor

[57] ABSTRACT

A package comprising a plurality of filled sealed containers containing dispensable materials, adjacent containers (20*a*, 20*b*) being connected by a joint (40) which comprises a tear means (50) allowing the containers, to be torn open with a single tearing action.

12 Claims, 4 Drawing Sheets

MULTI-COMPONENT PACKAGING SYSTEM

Figure 1A:
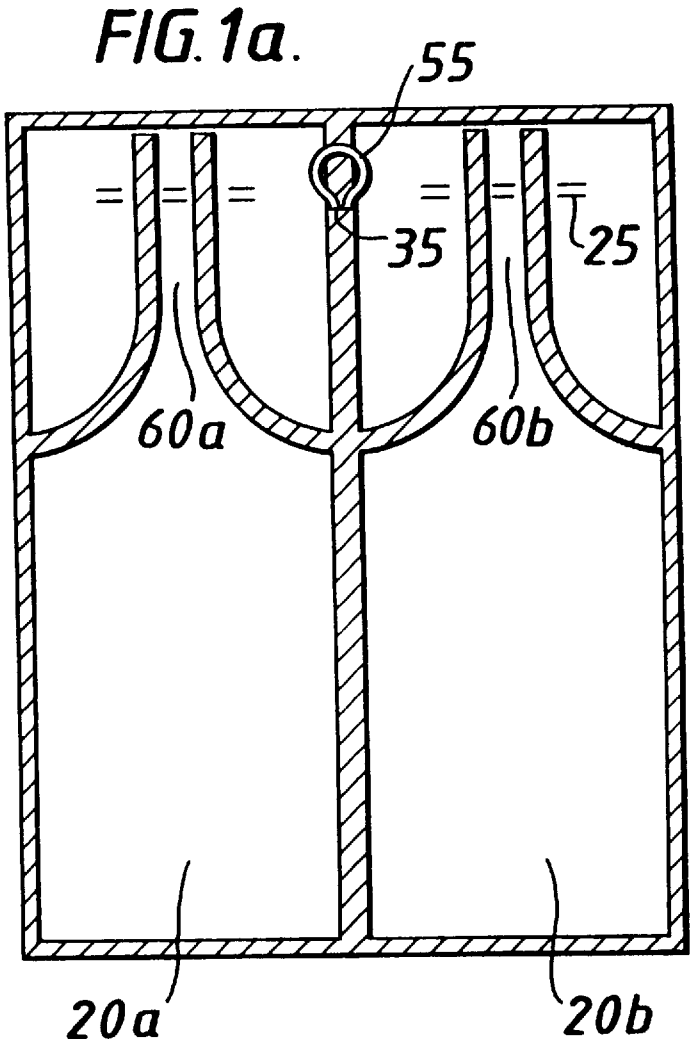

It is often the case in industry and medicine that multi-component systems are used, whereby pre-determined amounts of several components are mixed together either shortly before use or whilst being used.

For example, in the field of adhesives a dual component system may be used in which an activator is added to an unactivated composition in order that an adhesive is only formed shortly before it is intended to use it.

This avoids the potential problems of adhesive sticking to the sides of a container in which it may be stored and of the adhesive deteriorating during storage.

In the field of medicine also, dual component systems are used. For example foam cavity wound dressing systems are known in which a catalyst, cross linking agent or foaming taken from one container is added to a fluid polymer taken from another container in order that a foam is produced which can be poured into a cavity wound whilst liquid, and which then sets in situ. By using such a system a dressing can be produced which fills the cavity and which accurately conforms to the contours of the wound surface.

Such a dual component system is sold by The Wellcome Foundation Limited under the designation of "Silastic Foam Dressing".

However known multi-component systems can be disadvantageous in that user-compliance is often poor, especially with inexperienced users.

Thus, in the case of dual cavity wound dressing systems, for example, an inexperienced nurse may apply only one component of a two-component dressing to a wound site, with the result that an effective wound cavity dressing is not formed. This can happen despite clear packaging instructions. It can even happen with relatively experienced nurses, when under stress, as may often occur when treating large wound cavities.

There is therefore a long-established need to improve the ease with which multi-component systems can be used, especially for relatively inexperienced users.

In EP-0359847A and its counterpart U.S. Pat. No. 4,903,842 there is disclosed a container which inter alia can comprise two independently sealed components and which can be opened by removing a single strip of material for the region which separates and seals the components from each other to form two adjacent slits, each along one side of each component. The contents of the components are expelled and mixed together by bending and pushing the components together.

Whilst meeting the objective of being able to open both components in a single action there are a number of disadvantages associated with this design firstly, the non-sealed portion, for initiating opening, between the lid of the component and the remaining body, may compromise the integrity of both component seals since seal between the peripheral portions of the lid and body is smallest at this point. Further as this unsealed portion is at the periphery of the container there is an inherent danger that the unsealed portion may be inadvertently lifted and, because the seal is weakest at this point, it can break and thus expose the contents of both content-holding portions. A second disadvantage is that the bearable strip is itself part of the seal between the two containers. If the seal itself is too strong, the bond between the strip and the rest of the body may cause the strip to break when it is being pulled and for parts to remain attached or adhered to the lid or content-holding portions of the container.

U.S. Pat. No. 3,685,645 discloses a dual packaging system which comprises two containers which may be folded around a joining means and then torn open by a simultaneous single tearing action. However, the tearing action will be in a line parallel with the fold line.

Furthermore the arrangements described in the reference can only be used for opening a maximum of two components in a single action.

The present invention seeks to provide a multi-component packaging system which not only overcomes the disadvantages of the prior art but also provides advantages in ease of manufacture and can be readily adapted for three or more separately sealed components to be opened in a single action.

According to the present invention there is provided a multi-component packaging system (10) comprising a plurality of sealed flexible containers (20*a* and 20*b*) containing dispensable materials, each container being joined to at least one adjacent container by foldable joining means (40) whereby adjacent containers can be folded to overly each other wherein each joining means (40) is provided with tear promoting means (50) being aligned with each other to allow the overlying compartments to be torn open simultaneously with a single tearing action characterised in that the tear promoting means is arranged to promote tearing in a line transverse with respect of the direction of the fold.

As used herein the term "multi" or "plurality" means at least two. Fluid materials are materials which exhibit fluid properties such materials include liquids, gels, solids such as powders or other particulate compositions and gases.

According to an aspect of the invention there is provided a package comprising a first sealed container containing a first component and a second sealed container containing a second component of a different chemical composition from the first component; wherein the first and second containers are connected by a join which comprises a tear means allowing both containers to be torn open with a single tearing action.

The tear means can be any suitable means for tearing open the first and second containers. For example, it may be one or more slits which may extend at least partially through the joint. The slits can provide initiation points for a tear which can be induced by a user when the two containers are folded over one another, as will be described later.

Alternatively the tear means may be a resilient thread which extends across both the containers and is secured thereto (e.g. by welding or by adhesive). By pulling the thread away from the containers, both containers are caused to open.

In a further alternative, the tear means may simply be a region of the multi-component system located between the adjacent containers which is formed of material of lower tear strength than material at other regions of the package.

According to one embodiment of the invention the package is formed of flexible material in order that it can be folded along a join between two adjacent containers so that one of the containers can overly the other and the tear means then exposed. To this end a fold line may be provided to aid in folding along the join, which may consist of a crease or a depression formed along the join.

Thus the invention is applicable in respect of two-container systems where there is a common join between the two containers. Alternatively, more than two containers may be joined edgewise to adjacent containers, the edges of each container defining the join with the adjacent container. The container may then be fan-folded such that tear means in each join align with each other and are operable by a single tearing action.

When the package has been folded as described above a user can simply grasp the tear means and manually tear open the containers simultaneously.

Desirably no tear means are located at peripheral edges of the package in order that the containers are adapted only to be torn open by using a tear means located between adjacent containers, i.e. when the containers overly each other.

Thus the tearing open of only one of the containers but not any other can be avoided.

The present invention accordingly provides a method for opening two containers each comprising different components of a multi-component system which are joined together by a join comprising a tear means; wherein the containers are folded and then the tear means is used to tear open the two containers with a single tearing action.

Desirably the join of the package of the present invention is formed of a material which is resistant to tearing along the length of the join in order that the first and second containers cannot readily be separated.

In an alternative embodiment of the invention, an assembly of containers may be produced wherein each container is joined to an adjacent container by a common wall or septum rather than a common edge.

Preferably the tear promoting means is located on or in the join at a region different or remote from that part of the join which forms the common wall or edge.

Optionally, the package may comprise a material which facilitates tearing along a particular direction e.g. an oriented material. Such materials include oriented polyamide and oriented polyethylene tetraphthalate (in which a number of polyethylene fibres are arranged suitably parallel to one another so as to promote tearing along a direction parallel to the length of the fibres).

Such a material may be used in addition to the tear means so that once a tear has been initiated it can be propagated in a desired direction causing the adjacent containers to be opened by tearing at pre-determined parts thereof. Desirably the containers are provided with nozzles and the nozzle region at least of each container are formed from an oriented material propagated so as to open all containers simultaneously at the nozzle regions. This provides opened nozzles which can be used to direct the components as desired. Aptly, the nozzles may be positioned so as to overlie each other when the system is folded or constructed as described herein. This is advantageous in that the components can be directed together to a site where they are to be applied, and is also of assistance in aiding mixing.

Before tearing the nozzles open, it is desirable to force material away from the nozzle regions towards the remainder of each container. Where the container fabric is a pliable material this can be done by sliding a finger and thumb downwards from the tops of the nozzle regions whilst applying pressure to the containers. The finger and thumb can then be held in place at the bottom of the nozzle regions so as to temporarily prevent material re-entering the nozzle regions whilst the containers are torn open across the nozzles. Keeping a finger and thumb in place the torn open containers can then be moved towards a desired site where the components are to be applied. Then the finger and thumb can be removed so that the components can be applied to the site.

In this embodiment it is desirable that each of the containers only be filled to such a level so that material in the nozzle region can be squeezed into the rest of the container without causing rupture thereof. Aptly the containers are each filled to a level of less than 95% (e.g. of less than 80% or of less than 60%) of total volume capacity. In this embodiment of the present invention it is also desirable that each container should be in the form of flexible containers (e.g. sachets) and that the nozzle regions are each desirably of a width of less than 2 cm so that it can be readily sealed between a finger and thumb. More preferably the width of the nozzle at this region is between 0.1 cm and 1 cm.

The nozzle may have a varying cross-sectional area over its length e.g. it may be conical or hour glass shaped. In addition more than one tear promoting means may be provided to align with various parts of the nozzle. In this way it may be possible, by selecting a particular tear-promoting means to produce an opening in the container (in the nozzle) or selected cross-section. In this way the entrants of the containers may be dispensed and mixed more or less quickly, as desired.

The remainder of each container is desirably of a maximum width of no more than 5 cm (widths referred to herein are measured from inner wall to inner wall of the container) to aid in manually evacuating the components from the containers, e.g. by using a finger and thumb.

Alternatively, a specially adapted tool may be used to evacuate the container, in which case the widths are not crucial. (It should be noted that the term "evacuate" when used here does not necessarily imply complete emptying but includes partial emptying of the containers).

The tool comprises means for squeezing sides of each containers together and can be slid along the containers towards the nozzles (if present).

The means for squeezing the sides together may consist of a narrow elongate slit through which the containers can be forced. The slit may be provided in a device which also comprises a flat region for use in stirring the components together. Alternatively, rollers may be used to evacuate the containers. Preferably the flat region is substantially wider than the remainder of the tool.

The packaging system of the present invention have particular application in the medical field where it is desired to mix two or more materials only at the time or point of use. For example foamed materials have been proposed to fill cavity wounds such as venous ulcer sites or large decubitus sores. Rather than pack the site with pre-formed foam, where the foam precursors have been mixed a location remote for the point of use, the present invention allows the foam precursors to be mixed at the point of use. By utilizing a tear operation, the system of present invention may be used on a once only basis and thus avoid possible continuation of the wound by rejected application.

Thus according to a further aspect of the present invention there is provided a medical dressing system comprising at least two components each separately contained in sealed containers wherein the containers are connected by a join which comprises tear means thereby allowing the container to be torn open simultaneously with a singly tearing action.

In a preferred form of this aspect of the invention the dressing system will comprise two scaled containers, the first containing a foamable composition and the second containing a foaming agent for the foamable composition whereby upon tearing open of the containers and egress of the contents they will admix to form a foam. Such foams may therefore be formed at any chosen site, for example to fill a wound cavity.

The invention may also have applications in the non-medical fields. For example, a two component system may be utilized to hold an epoxy resin precursor in a first sealed container and a catalyst for the resin forming reaction in the second container. Upon simultaneous opening of the container and admixing of the contents therefrom a resin forming reaction may occur.

Figure 1:
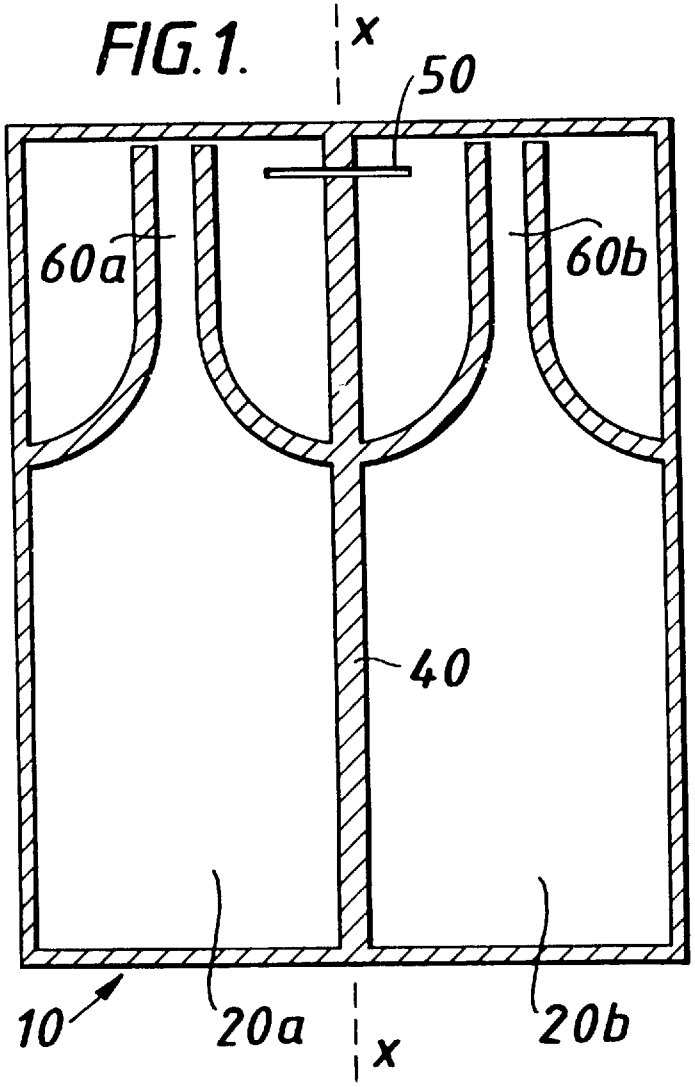

The present invention will now be described by way of example only, with reference the accompanying drawings, wherein:

FIG. 1 shows a plan view of a first embodiment of a package according to the present invention.

FIG. 1*a* shows a plan view of a first embodiment of a package according to the present invention.

Figure 2:
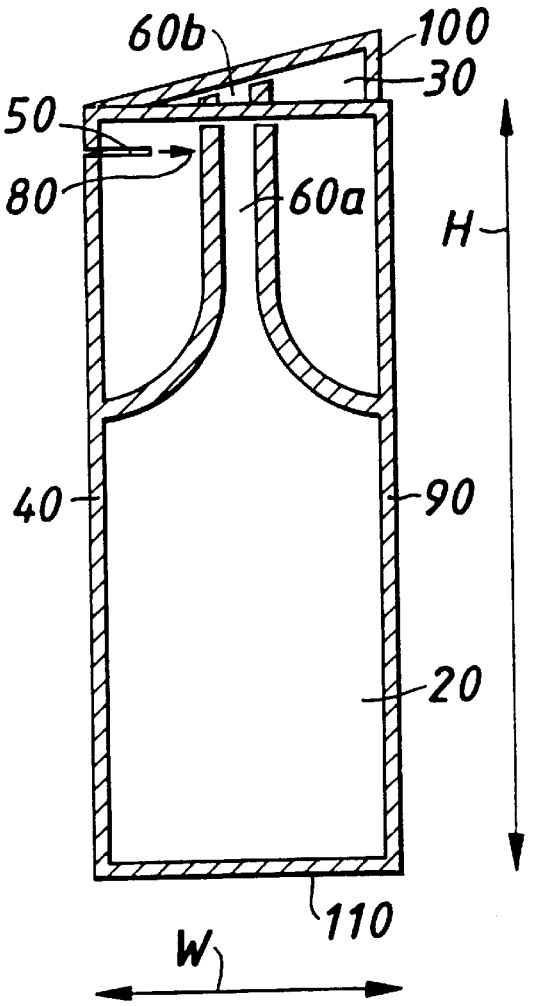

FIG. 2 shows a view of the embodiment shown in FIG. 1 when in a folded configuration.

Figure 2A:
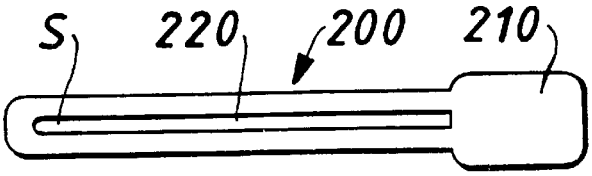

FIG. 2*a* shows a tool which is adapted for use with the embodiment of the present invention shown in FIGS. 1 and 2.

Figure 2B:
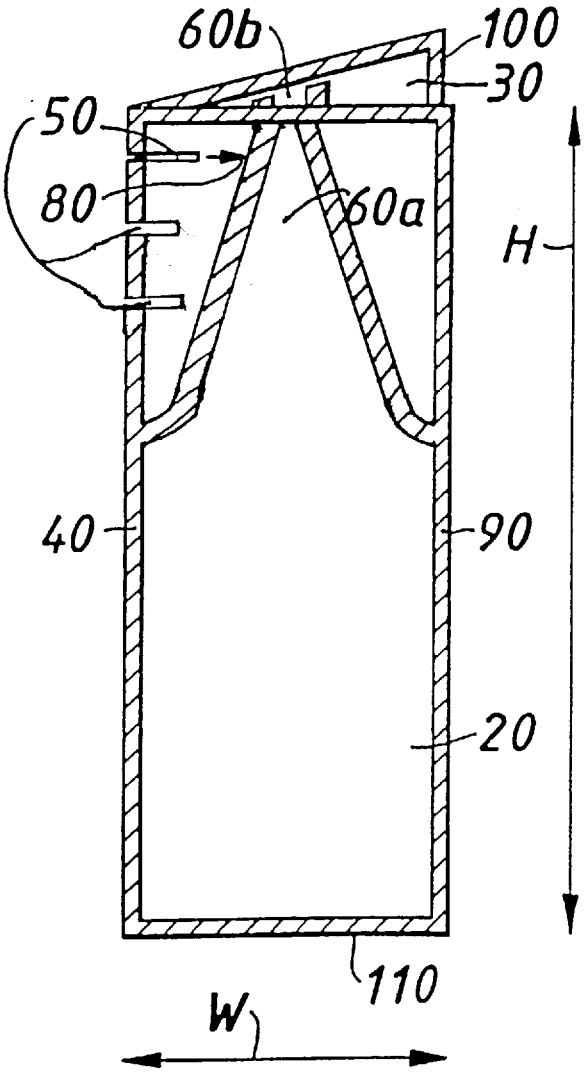

FIG. 2*b* shows a view of an alternative embodiment of the invention having a nozzle portion of varying cross-section and a plurality of tear promoting means.

Figure 3A:
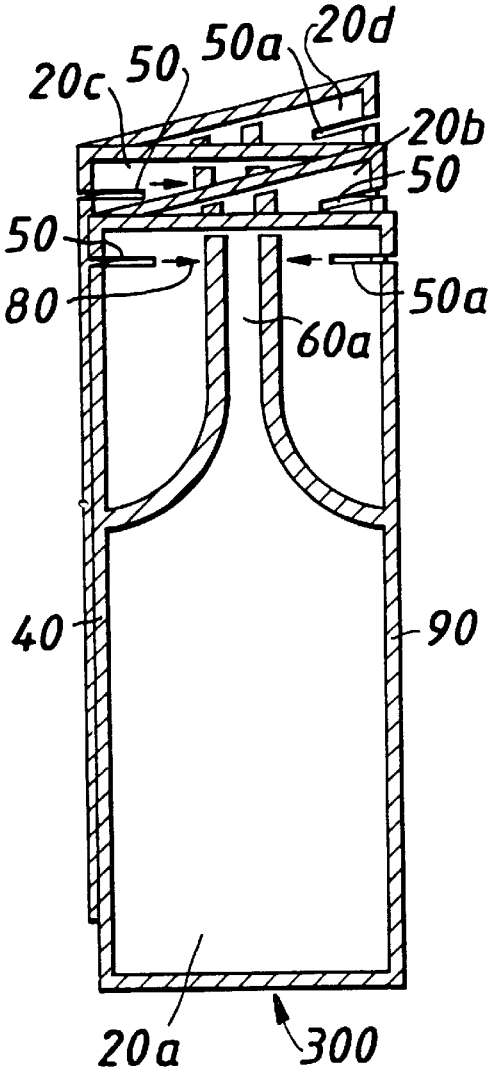
Figure 3:
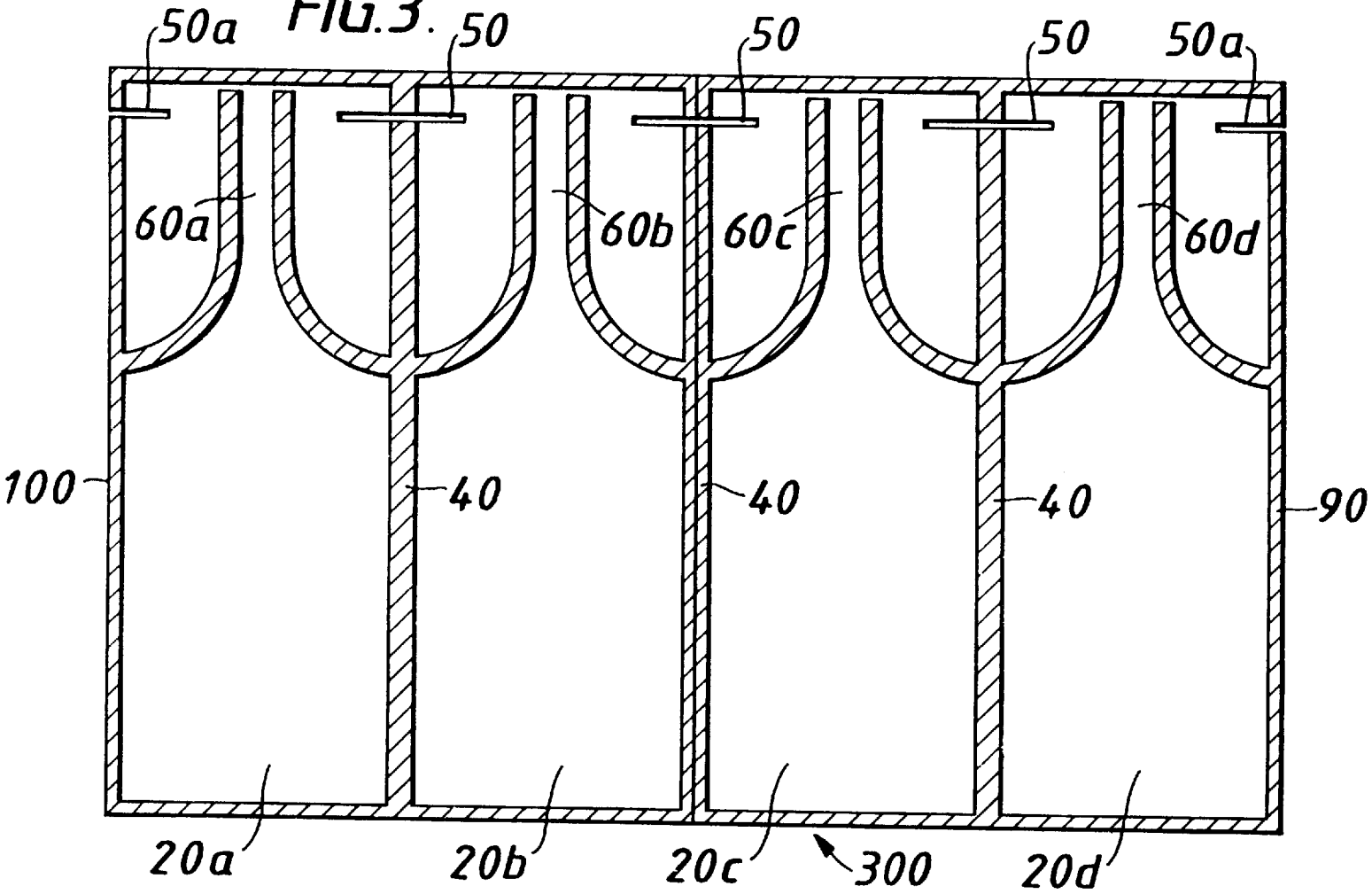

FIG. 3 shows a plan view of a third embodiment of the present invention.

FIG. 3*a* shows a view of the embodiment shown in FIG. 3 when in a folded configuration.

Referring now to FIG. 1 a packaged dual component system 10 is shown which comprises first and second containers 20*a* and 20*b* respectively. Package 10 is formed from two sheets of flexible, laminated material which have been heat sealed together along the shaded regions indicated in the drawing. Each laminated sheet consists of the following arrangement of layers (in the order given):—

Oriented Polyethylene Tetraphthalate

Aluminium Foil

Oriented Polyamide

Polythene

Heat sealing is achieved by bringing the polythene faces together and applying a combination of heat and pressure such that the polythene surfaces partially melt and combine. Once cool, the two surfaces will have formed a welded seal.

One of these seals, 40, forms a join between the two containers 20*a* and 20*b* about which these containers can be folded along line x—x so as to overlie one another, as indicated in FIG. 2 (for the sake of clarity the fold line x—x is not specifically identified in the other drawings).

An elongate horizontal slit 50 is provided, which perforates weld 40 and which continues to a limited extend either side of this weld.

Slit 50 lies adjacent nozzles 60*a* and 60*b* of containers 20*a* and 20*b* respectively. As can be appreciated, if this slit is extended by tearing, it would cut across nozzles 60*a* and 60*b* and cause containers 20*a* and 20*b* to open. For ease of manufacture, slit 50 is provided so that it extends through all of the layers of the laminate. However since its function is simply to provide an initiation point of tearing, it could be provided so as to extend through only one layer i.e. an outer layer of the laminate.

Considering now FIG. 1*a*, there is shown a package identical with that shown in FIG. 1 except that rather than providing slit 50 as the tear means, a resilient thread 55 performs this function. This thread 55 is heat sealed along most of its length between layers of the laminate from which assembly 10 is formed (indicated by dotted region 25, which are shown merely for illustration and would not be seen in practice), but thread 55 protrudes through aperture 35 and 45 to present a loop 55.

Loop 55 allows the thread to be easily grasped by a user so that it can then be pulled and cause containers 20*a* and 20*b* to open by tearing.

FIG. 2 shows the package shown in FIG. 1 when folded so that first container 20*a* overlies second container 20*b*.

This arrangement means that a user can tear open containers 20*a* and 20*b* by a single tear along the direction of arrow 80. Slit 50 provides an initiation point for the tear and is positioned so that tearing occurs across nozzles 60*a* and 60*b*.

This is particularly advantageous since nozzles 60*a* and 60*b* allow components from container 20*a* and 20*b* to be accurately directed to a site of application. Furthermore, since the nozzles 60*a*, 60*b* are positioned so as to overlie each other when the package is folded, both components can be directed in close proximity to one another so as to aid mixing, and a single action can be used to empty both containers 20*a* and 20*b*, as will be described later.

In order to ensure that a tear does indeed propagate along the direction of arrow 80, in addition to the provision of elongate slit 50, the package is provided with a layer of oriented polyethylene (not shown) which is incorporated into the laminate of which the assembly is formed. This layer comprises polyethylene fibres oriented horizontally with respect to FIG. 1 so that the layer facilities tearing along an horizontal direction, but is resistant to tearing along other directions. This provides an additional advantage in that the package resists tearing along the join 40 between containers 20*a* and 20*b*. This is important because if the containers were separated, an inexperienced user might use only one of the two components of the dual component system.

It should be appreciated that no tear means is provided on the assembly apart from that located along the join 40 between the two containers 20*a* and 20*b* (i.e. the slit 50). Thus no tear means are provided, for example, along seal 90 or seal 100 at the outer edges of the assembly. This is because if such additional tear means were provided it would be possible to open one of containers 20*a* or 20*b* without opening the other, whereas the arrangement shown in FIG. 2 is adapted to require both containers 20*a*, 20*b* to be opened simultaneously.

In order to make the assembly 10 even easier to use seals 90 and 100 can be attached together so that it is not necessary for a user to fold the container, since slit 50 would already be exposed for use. Indeed a single heat seal may be present instead of separate head seals 90 and 100 so that the package is manufactured with containers 20*a* and 20*b* already overlying each other and with slit 50 exposed.

The containers 20*a* and 20*b* shown in FIG. 2 are adapted to disperse equal volumes of each of two components of a dual components of a dual component system, both containers 20*a*, 20*b* being of the same shape and filled to the same level.

Before tearing open the containers 20*a* and 20*b* liquid may be expelled from the nozzle regions 60*a* and 60*b* by using a finger and thumb, between which the package is grasped, to force liquid into the remainder of the container. The finger and thumb can then be held in place below the nozzle regions where the containers 60*a*, 60*b* are torn whilst the containers are opened and kept in place until the containers 60*a*, 60*b* are positioned over a site for applying the two components (this avoid unnecessary leakage). The finger and thumb can then be released and the containers can be partially or completely emptied.

Emptying may also be done by using a finger and thumb, wherein the containers 20*a*, 20*b* are compressed between the finger and thumb whilst still overlying each other and the finger and thumb are slid at least partially along the length of containers 20*a*, 20*b* starting from the bottom of the containers 110. This is advantageous in that a single action can be used to expel liquid from both containers 20*a*, 20*b*. Furthermore, even if the containers 20*a*, 20*b* are partially evacuated (e.g. where the finger and thumb are only slid half-way along the length of the containers 20*a*, 20*b*), substantially equal volumes from each container 20*a*, 20*b* will be expelled so that the desired 1:1 ratio of the two components is applied to a site of application.

If it is desired to expel non-equal volumes from two containers 20*a*, 20*b* then a similar system can be used, but the width W of one of the containers can be made larger than that of the other (at least over that part of the container which does not form a nozzle), whilst the height H of both containers is kept the same.

It should be noted that the arrangement shown in FIG. 2 can be easily modified to be suitable for a three or more component system. Thus several containers can have a common seal 40 and can be arranged in a fan like arrangement about this seal so that they form a stack of overlying containers. Tearing at slit 50 along the direction of arrow 80 can then cause all of the containers to be opened simultaneously.

Referring now to FIG. 2*a*, a dual purpose tool 200 is shown for aiding the simultaneous dispensing of the two components from containers 20 and 30.

The tool 200 is in the form of a spatula, having a flat end 210 for use in stirring the components from containers 20 and 30 when they have been dispersed. Tool 200 also comprises an elongate slit 220. The function of this slit is to receive the assembly in the folded configuration shown in FIG. 2 when containers 20 and 30 have been torn open. The size of the slit S is adapted so that the tool can be slid along the torn open, folded assembly so as to substantially expel the components of the two-component system. This provides a quicker and more accurate way of dispensing these components than relying upon a user squeezing them out of containers 20 and 30 using a finger and thumb.

Referring now to FIG. 3, there is shown an alternative packaged dual component system 300, in which four containers 20*a*, 20*b*, 20*c* and 20*d* are joined side by side manner, with nozzles 60*a*, 60*b*, 60*c*, 60*d* lying parallel to one another.

As can be seen in FIG. 3*a* the containers 20*a*, 20*b*, 20*c*, 20*d* and each folded along joins 40 to form a four folded arrangement and overly each other. The tear-promoting slits 50 (and 50*a*) are aligned. Slits 50*a* are formed when a series of joined containers are cut along join 40. In this embodiment it is possible to propagate the tear from either side of the assembly 300. In an alternative batch construction a separate slit 50*a* may be omitted. In this arrangement the tear may only be readily propagated from the left hand side.

I claim:

1. A multi-component packaging system comprising a plurality of sealed flexible containers containing dispensable materials, wherein at least one container is adapted to form a nozzle portion having a longitudinal axis and a cross-sectional area which varies in size at different points along the longitudinal axis of the nozzle portion; each container being joined to at least one adjacent container by a foldable joining means, whereby when said foldable joining means is folded along a fold, adjacent containers overly each other; each joining means is provided with a plurality of tear promoting means, said tear promoting means being selected from a slit in said foldable joining means, a notch in said foldable joining means and a thread incorporated in the container, each of said tear promoting means being provided at points along the longitudinal axis of the nozzle portion having different cross-sectional areas to allow the container to be torn open at a selected point along the longitudinal axis of the nozzle portion, and each tear promoting means is arranged to promote tearing across the nozzle portion in a line transverse with respect to the direction of the fold.

2. A kit for dispensing fluid materials comprising a system as claimed in claim 1 and means for squeezing out the contents of each container.

3. A kit as claimed in claim 2 wherein the squeezing means comprises a body having an aperture therethrough, said aperture being adapted to receive the system when the filled containers are arranged to overly each other and wherein said aperture is further adapted to impart a squeezing action onto said filled containers when received in said aperture.

4. A kit as claimed in claim 2 wherein each container contains a chemically different component.

5. A kit as claimed in claim 4 wherein a first container contains chemical reactants suitable for a catalysible reaction and a second container contains catalyst for catalysing said reaction.

6. A medical dressing kit for filling wound cavities comprising a kit as claimed in claim 2 wherein a first container contains a foamable composition and a second container contains a foaming agent capable of foaming said foamable composition.

7. A system as claimed in claim 1 wherein each container contains a chemically different component.

8. A system as claimed in claim 7 wherein a first container contains chemical reactants suitable for a catalysible reaction and a second container contains catalyst for catalysing said reaction.

9. A medical dressing system for filling wound cavities comprising a system as claimed in claim 7 wherein a first container contains a foamable composition and a second container contains a foaming agent for foaming said foamable composition.

10. A method for dressing a wound cavity which comprises arranging a dressing system as claimed in claim 9 such that the containers overly each other, simultaneously opening each container by operation of the tear promoting means, aiming the open ends of the arranged containers toward a wound cavity and squeezing the container to expel the contents in admixture into the wound cavity.

11. A system as claimed in claim 1 wherein the joining means comprises a common septum between adjacent containers and the tear promoting means is located at a point on said joining means which is remote from said common septum.

12. A method for dressing a wound cavity with a dressing system which includes a medical dressing kit for filling wound cavities including a kit for dispensing fluid materials provided with a plurality of sealed flexible containers containing dispensable materials, each container being joined to at least one adjacent container by a foldable joining means, whereby when said foldable joining means is folded along a fold, adjacent containers overly each other, each joining means is provided with a tear promoting means, said tear promoting means being selected from a slit in said foldable joining means, a notch in said foldable joining means and a thread incorporated in the container and positioned to allow the overlying containers to be torn open simultaneously with a single tearing action, each tear promoting means being arranged to promote tearing in a line transverse with respect to the direction of the fold, and means for squeezing out the contents of each container; comprising the steps of arranging the containers overly each other, simultaneously opening each container by operation of the tear promoting means, aiming the open ends of the overlying containers toward a wound cavity and squeezing the containers to expel the contents in admixture into the wound cavity.

* * * * *